US010336419B1

(12) United States Patent
Guse et al.

(10) Patent No.: US 10,336,419 B1
(45) Date of Patent: Jul. 2, 2019

(54) SHOCK ABSORBING HUB ASSEMBLIES AND METHODS OF MAKING SHOCK ABSORBING HUB ASSEMBLIES FOR MARINE PROPULSION DEVICES

(71) Applicant: Brunswick Corporation, Lake Forest, IL (US)

(72) Inventors: Daniel J. Guse, Fond du Lac, WI (US); Jeremy L. Alby, Oshkosh, WI (US); Jeffrey C. Etapa, Oakfield, WI (US)

(73) Assignee: BRUNSWICK CORPORATION, Mettawa, IL (US)

( * ) Notice: Subject to any disclaimer, the term of this patent is extended or adjusted under 35 U.S.C. 154(b) by 802 days.

(21) Appl. No.: 14/943,187

(22) Filed: Nov. 17, 2015

Related U.S. Application Data

(60) Provisional application No. 62/114,127, filed on Feb. 10, 2015.

(51) Int. Cl.
*B63H 1/20* (2006.01)

(52) U.S. Cl.
CPC ..... *B63H 1/20* (2013.01)

(58) Field of Classification Search
CPC .. F04D 29/20; B63H 1/12; B63H 1/14; B63H 1/15; B63H 1/20; B63H 20/00; B63H 23/34; B63H 2023/342; B63H 2023/344; B63H 2023/346
See application file for complete search history.

(56) References Cited

U.S. PATENT DOCUMENTS

| | | | |
|---|---|---|---|
| 4,642,057 | A | 2/1987 | Frazzell et al. |
| 5,244,348 | A | 9/1993 | Karls et al. |
| 5,322,416 | A | 6/1994 | Karls et al. |
| D368,058 | S | 3/1996 | Robinson |

(Continued)

OTHER PUBLICATIONS

Mercury Marine to release new Flo-Torq propeller hub system, posted at Mercurymarine.com, posted on Jul. 30, 2015, site visited Apr. 11, 2017, <https://www.mercurymarine.com/en/us/news/mercury-marine-to-release-new-flow-torq-propeller-hub-system/?utm_term=en&utm_medium=ca+utm_source=Overlay_IP%3Dus&utm_campaign=Region+Redirection>.

(Continued)

*Primary Examiner* — Carlos A Rivera
*Assistant Examiner* — Alexander A White
(74) *Attorney, Agent, or Firm* — Andrus Intellectual Property Law, LLP

(57) ABSTRACT

Shock absorbing hub assemblies and methods of making the same for marine propulsion devices having a propeller shaft and propeller. The assembly has an adapter component having an inner bore that engages the propeller shaft's splined outer surface and having a body with axially extending engagement surfaces on one end and an elastic hub component on an opposite end. The elastic hub component has planar outer engagement surfaces that abut corresponding inner engagement surfaces on the propeller hub's inner bore. Upon initial propeller shaft rotation, the elastic hub component deflects and allows the adapter component to rotationally travel relative to the propeller hub while not rotating the propeller hub. Upon further rotation, the adapter component's axially extending engagement surfaces engage with the propeller hub to rotate the propeller hub. The elastic hub component has a spring rate small enough to reduce clutch rattle yet large enough to isolate transmission shift clunk.

20 Claims, 14 Drawing Sheets

(56) References Cited

U.S. PATENT DOCUMENTS

| | | | | |
|---|---|---|---|---|
| 5,548,981 | A | 8/1996 | Kirk | |
| D419,860 | S | 2/2000 | Persson | |
| 6,478,543 | B1 * | 11/2002 | Tuchscherer | B63H 23/34 416/134 R |
| D515,399 | S | 2/2006 | Ho | |
| 7,008,188 | B2 * | 3/2006 | Booe, Jr. | B63H 1/15 416/134 R |
| 7,234,330 | B2 | 6/2007 | Tseng | |
| 7,708,526 | B2 * | 5/2010 | Chen | B63H 23/34 416/134 R |
| D645,382 | S | 9/2011 | Verbowski | |
| D658,481 | S | 5/2012 | Pratt | |
| D661,975 | S | 6/2012 | Mahaffey | |
| 8,277,269 | B1 * | 10/2012 | Alby | B63H 23/34 416/2 |
| 8,419,489 | B2 | 4/2013 | Tsunekawa et al. | |
| D771,434 | S | 11/2016 | Burrows | |
| D781,956 | S | 4/2017 | Scott | |
| 2009/0016896 | A1 * | 1/2009 | Hill | F03D 1/0658 416/244 R |
| 2012/0167369 | A1 | 7/2012 | Holcomb | |
| 2014/0109328 | A1 | 4/2014 | Rauch | |
| 2014/0205455 | A1 * | 7/2014 | Kuroki | B63H 23/34 416/134 R |

OTHER PUBLICATIONS

Mercury Marine Wins International Innovation Award, posted at Bassanglermag.com, posted on May 4, 2016, site visited Apr. 11, 2017, <http://bassanglermag.com/mercury-marine-wins-international-innovation-award/>.

* cited by examiner

SHOCK ABSORBING HUB ASSEMBLIES AND METHODS OF MAKING SHOCK ABSORBING HUB ASSEMBLIES FOR MARINE PROPULSION DEVICES

CROSS-REFERENCE TO RELATED APPLICATION

The present application claims priority to and the benefit of U.S. Provisional Patent Application Ser. No. 62/114,127, filed Feb. 10, 2015, which is hereby incorporated herein by reference, in entirety.

FIELD

The present disclosure relates to propeller assemblies for marine propulsion devices, and more specifically to assemblies for absorbing shock and other forces applied to a propeller hub during a shifting operation of marine propulsion device.

BACKGROUND

The following U.S. Patents and Publication are hereby incorporated herein by reference, in entirety.

U.S. Pat. No. 4,642,057 discloses a marine propeller mounting arrangement that includes a sleeve member for mounting on a propeller shaft, a propeller having an inner hub which fits over the sleeve member and a cushion member fitting between the sleeve member and the propeller inner hub. The sleeve member includes radially extending projections registering with channels in the hub to positively drive the propeller, even in the event of failure of the cushion member. The propeller has an outer hub surrounding the inner hub to define an exhaust gas passageway through the propeller.

U.S. Pat. No. 5,322,416 discloses, in a marine drive, a drive sleeve between the propeller shaft and the propeller hub that absorbs shock after the propeller strikes an object by torsionally twisting between a forward end keyed to the propeller hub and a rearward end keyed to the propeller shaft. The drive sleeve is composed of a plastic material providing torsional twisting angular rotation at a first spring rate less than 100 lb. ft. per degree from zero degree to five degree rotation, a second higher spring rate beyond five degree rotation, and supporting over 1,000 lb. ft. torque before failure.

U.S. Pat. No. 6,478,543 discloses a torque transmitting device for use in conjunction with a marine propulsion system that provides an adapter that is attached in torque transmitting relation with a propulsor shaft for rotation about a central axis of rotation. The first insert portion is attached in torque transmitting relation with the adapter and a second insert portion is attached in torque transmitting relation with a hub of the propulsor hub which can be a marine propeller or an impeller. A third insert portion is connected between the first and second insert portions and is resilient in order to allow the first and second insert portions to rotate relative to each other about the central axis of rotation. The adapter is shaped to prevent compression of the first, second, and third insert portions in a direction parallel to the central axis of rotation. The relative shapes of the various components and the resilience of the third insert portion, which can be a plurality of titanium rods, provides significant compliance of the device under low torque magnitudes, but at higher torque magnitudes it provides a significantly decreased compliance to facilitate torque transfer between a propulsor shaft and the propulsor hub.

U.S. Pat. No. 8,277,269 discloses a torque transmitting device and a marine propulsion system that include an adapter that comprises a first portion shaped to engage in torque-transmitting relation with a propulsor shaft of the marine propulsion system so that rotation of the propulsor shaft about the axis of rotation causes synchronous rotation of the first portion about the axis of rotation. A second portion is shaped to engage in torque-transmitting relation with a propulsor hub of the marine propulsion system. The second portion is connected to the first portion by a plurality of elongated torsional members that are integrally attached to at least one of the first and second portions. The elongated torsional members are resilient so as to allow the first portion and second portion to rotate relative to each other about the axis of rotation.

U.S. Pat. No. 8,419,489 discloses a propeller unit for a marine vessel propulsion device that includes an inner cylinder arranged to be fixed to the propeller shaft, an outer cylinder, a first driving force transmitting member, and a second driving force transmitting member. The propeller unit for marine vessel propulsion device further includes a pair of first engaging portions, and a pair of second engaging portions provided on the outer cylinder and the second driving force transmitting member. The pair of second engaging portions are arranged such that the mutual engaging of the respective second engaging portions is disengaged when a driving force is not transmitted to the propeller shaft and are arranged such that the respective second engaging portions become mutually engaged in a driving force transmittable manner by elastic deformation of the first driving force transmitting member when a driving force that is not less than a reference driving force is transmitted to the propeller shaft.

U.S. Patent Application Publication No. 2014/0205455 discloses a damper disposed between an outer peripheral surface of a bushing and an inner peripheral surface of an inner hub. The damper includes a first portion facing a rib of the bushing, a second portion facing a rib of the inner hub, and a connection portion by which the first portion and the second portion are connected to each other. In a state in which a rotational force has not been applied between the bushing and the inner hub, the damper includes a cross-sectional shape that defines a deformation-absorbing space positioned between the first portion and the second portion. The deformation-absorbing space is deformed such that the first portion approaches the second portion in a state in which the rib of the bushing and the rib of the inner hub have moved relatively by application of a rotational force between the bushing and the inner hub.

SUMMARY

This Summary is provided herein to introduce a selection of concepts that are further described herein below in the Detailed Description. This Summary is not intended to identify key or essential features from the claimed subject matter, nor is it intended to be used as an aid in limiting the scope of the claimed subject matter.

In certain examples a shock absorbing hub assembly is for a marine propulsion device having a propeller shaft and a propeller hub. The shock absorbing hub assembly comprises an adapter component having an inner bore that mates with a splined outer surface of the propeller shaft. The adapter component comprises a body having opposite first and second end portions. An elastic hub component is disposed on the second end portion of the body. The elastic hub component has a plurality of planar outer engagement surfaces that abut a plurality of corresponding inner engagement surfaces on an inner bore of the propeller hub. Upon initial rotation of the propeller shaft, the elastic hub component deflects and allows the adapter hub component to rotationally travel with respect to the propeller hub such that said initial rotation of the propeller shaft does not cause corresponding rotation of the propeller hub. Upon further rotation of the propeller shaft, the adapter component engages with the propeller hub such that said further rotation of the propeller shaft causes corresponding rotation of the propeller hub. The elastic hub component can have a spring rate that is small enough to reduce rattle of a clutch associated with the marine propulsion device and yet large enough to isolate shift clunk of a transmission associated with the marine propulsion device.

Methods of making a shock absorbing hub assembly are provided, including selecting a material of the elastic hub component having a spring rate that is small enough to reduce rattle of the clutch and yet large enough to isolate shift clunk of the transmission.

BRIEF DESCRIPTION OF THE DRAWINGS

Examples are described with reference to the following drawing FIGURES. Like reference numbers are used throughout the FIGURES to reference like features and components.

DETAILED DESCRIPTION OF THE DRAWINGS

Figure 1:
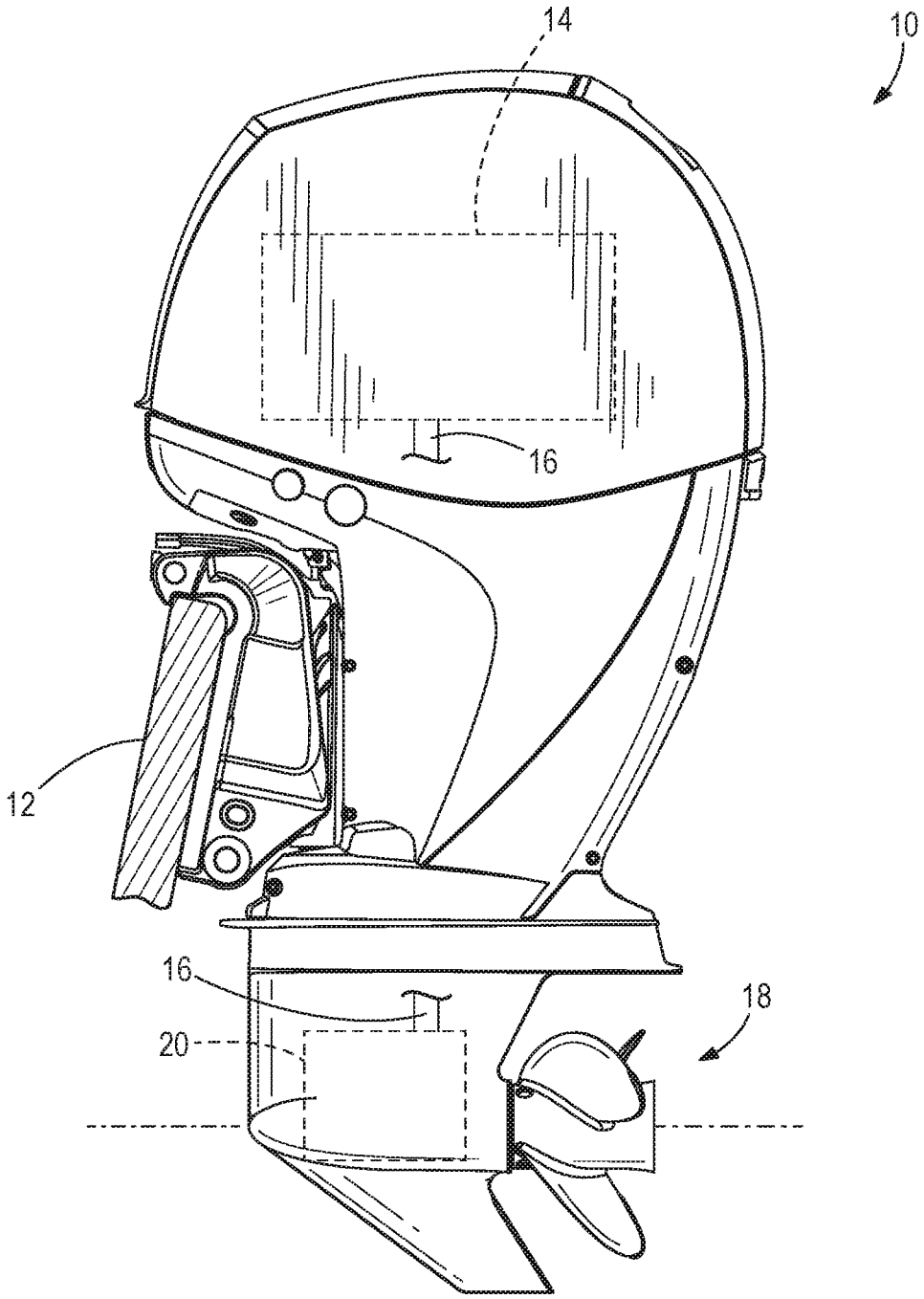
FIG. 1 is a side view of an exemplary outboard marine propulsion device.

Through research and experimentation, the present inventors have recognized and endeavored to solve problems associated with marine propulsion devices, and more particularly problems that have arisen with the introduction of newer, quieter, marine propulsion devices, including for example outboard marine propulsion devices ("outboard marine engines").

Many outboard marine engines produce an undesirable growling noise known as "clutch rattle". Clutch rattle is caused by a repeated separation and reconnection between the clutch and gear dogs as the outboard marine engine idles forwards or backwards while in gear. The separation happens because the propeller inertia is large enough to overcome the hydrodynamic drag torque, such that the propeller and propeller shaft with clutch maintain more rotation speed than the remaining drivetrain as the engine's crankshaft rotational speed varies. The engine's crankshaft rotational speed varies as the engine's cylinders go through the various compression, power, exhaust and intake strokes. These changes in rotational speed are only somewhat damped by the flywheel mass. This problem is especially found in four-stroke engines, which fire only half as often per revolution as the prior two-stroke engines, i.e. fewer and bigger torque pulses exacerbate the situation.

Shift shock is another undesirable noise associated with many marine propulsion devices, including outboard marine engines. Shift shock derives from the instantaneous acceleration of the propeller and propeller shaft as the clutch dogs contact the gear dogs and the propeller goes from zero rpm to idle rpm. The force of the sudden contact of the clutch and gear dogs causes air- and structure-borne noise, and the acceleration of the propeller induces undesirable vibration forces into the boat.

Through research and development, the inventors have endeavored to mitigate the effects of clutch rattle and shift shock, while maintaining the "field replaceable" convenience and durability of prior art hub systems, and while using the current/common propeller inner bore casting geometry. The present inventors have realized that some prior art propeller hubs have a very soft rotational rate and allow motion between the propeller and propeller shaft. This motion allows the clutch and gear dogs to remain in contact through the varying rotational drivetrain speed. Other prior art propeller hubs are configured with a significantly stiff rate that absorbs the energy and dampens the sudden contact and acceleration forces, thereby minimizing the noise and vibration experienced in the boat.

The present disclosure provides improved shock absorbing hub assemblies that fit with current field serviceable propeller inner bore geometry. In certain examples, the hub assemblies utilize an over-molded rubber section that, unlike the prior art, absorbs both clutch rattle and shift shock as it deforms in shear to allow rotational displacement between the propeller and propeller shaft. The presently disclosed hub assemblies can allow maximum displacement in minimal package size. The assemblies thus advantageously can incorporate relatively large rotational travel to thereby allow a single assembly to meet the requisite soft anti-clutch rattle hub spring rates while still being capable to absorb the significant energy during a shift event. In alternate examples, a dual rate is incorporated using simple geometry changes to the over-molded rubber. For example, longitudinal holes can be formed in the rubber which soften the rate until the rubber rotates closing the holes or outside shape angle variations can be provided to allow progressive contact of the rubber with the inner propeller bore.

To eliminate clutch rattle in a series of applications, the present inventors have determined that a particular rotational spring rate needs to be obtained. The inventors have determined that the acceptable window for this rate is affected by several key criteria. The engine's number of cylinders affects the upper bound of the allowable hub spring rate. Fewer cylinders create fewer, but larger pulses, requiring a softer rate to compensate for the larger rotational speed variations. More cylinders smooth the pulses, making clutch rattle less likely in general. A low pitch propeller reduces the propeller drag torque and drives the target rate window towards a lower/softer rate. A high pitch propeller increases the drag torque that can reduce the tendency to rattle; however, this higher drag torque uses up the allowable rotation in the hub. This drives the need for a stiffer rate for a given amount of available rotational displacement. A lower/deeper gear ratio can have the same effect as a low pitch propeller. A higher/less deep gear ratio can have the same effect as a high pitch propeller. Propeller diameter and material also affect the target spring rate. Larger diameter and heavier stainless steel propellers have a higher rotational inertia about the propeller shaft axis. Therefore, they have a greater tendency to maintain speed and drive clutch separation. If the spring rate is too high, the speed variation will not be taken up and the separation will occur. If the rate is too soft on a high inertia propeller, the hub could run out of travel prior to propeller shaft speed reversal and clutch separation will occur. Lower diameter and lighter aluminum propellers have lower inertia and decelerate quicker, minimizing the likelihood of rattle. For a typical three cylinder (or higher cylinder count) outboard engine with typical gear reduction, a target rate can be found and selected that is soft enough to keep the clutch dogs engaged on a high inertia, low drag propeller and yet stiff enough such that the allowable travel is not used up on a high inertia, high drag propeller. Each of these factors can be considered and accounted for during selection of the spring rate and geometry.

By allowing significant rotational displacement, in certain of the presently disclosed assemblies (possibly incorporating the noted additional dual rate rubber design features), the spring rate can also absorb the energy required to minimize shift clunk. To minimize shift clunk, the rate and displacement of the hub should be such that as much energy is absorbed as possible so that the acceleration of the propeller happens over the longest period of time given the available travel. It can also be important that during a shift event the full travel of the hub is not completely used. If the hub is too soft and bottoms out, the force transmitted by the sudden acceleration of the propeller and high contact forces at the clutch dogs will be more pronounced. In addition, if the hub bottoms out, additional separation and contact of the clutch dogs in rapid succession will be heard and felt until the propeller shaft and propeller speeds equalize. If the hub is too stiff, the propeller will accelerate faster than needed for a given amount of travel and the resulting noise and forces will not be minimized.

Therefore, through research and experimentation, the present inventors have determined that certain prior art anti-clutch rattle hub designs do not have high enough spring rates or enough travel to adequately isolate shift clunk events. Also, certain existing anti-shift clunk designs are too stiff to dampen the speed differences between propeller and propeller shaft to eliminate clutch rattle. Thus, according to the present disclosure, unique hub designs are provided that address both of these design concerns with low enough spring rates to eliminate rattle and yet the ability to absorb the significant shift shock energy.

Figure 2:
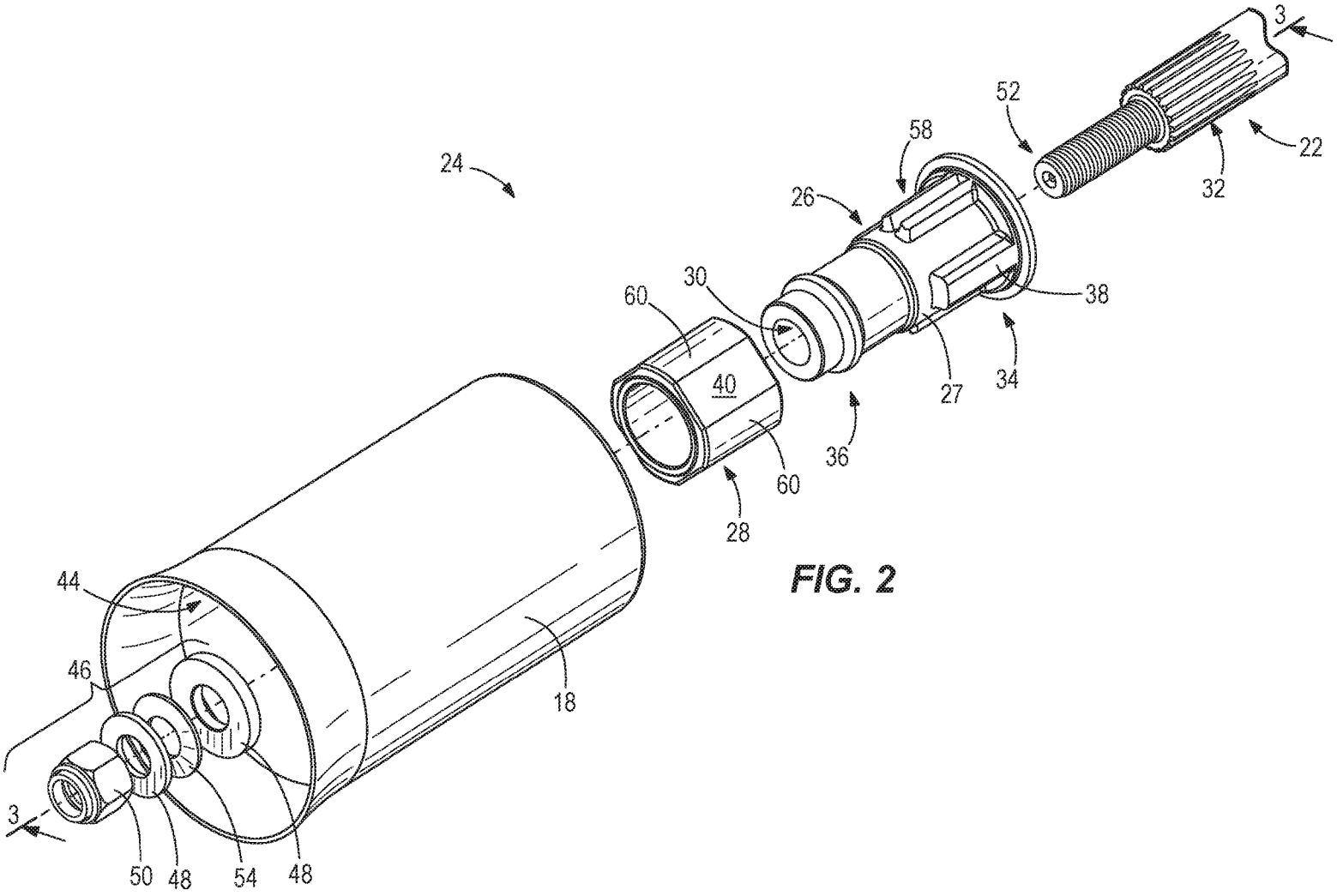
FIG. 2 is an exploded view of a shock absorbing hub assembly for the outboard marine propulsion device.
Figure 3:
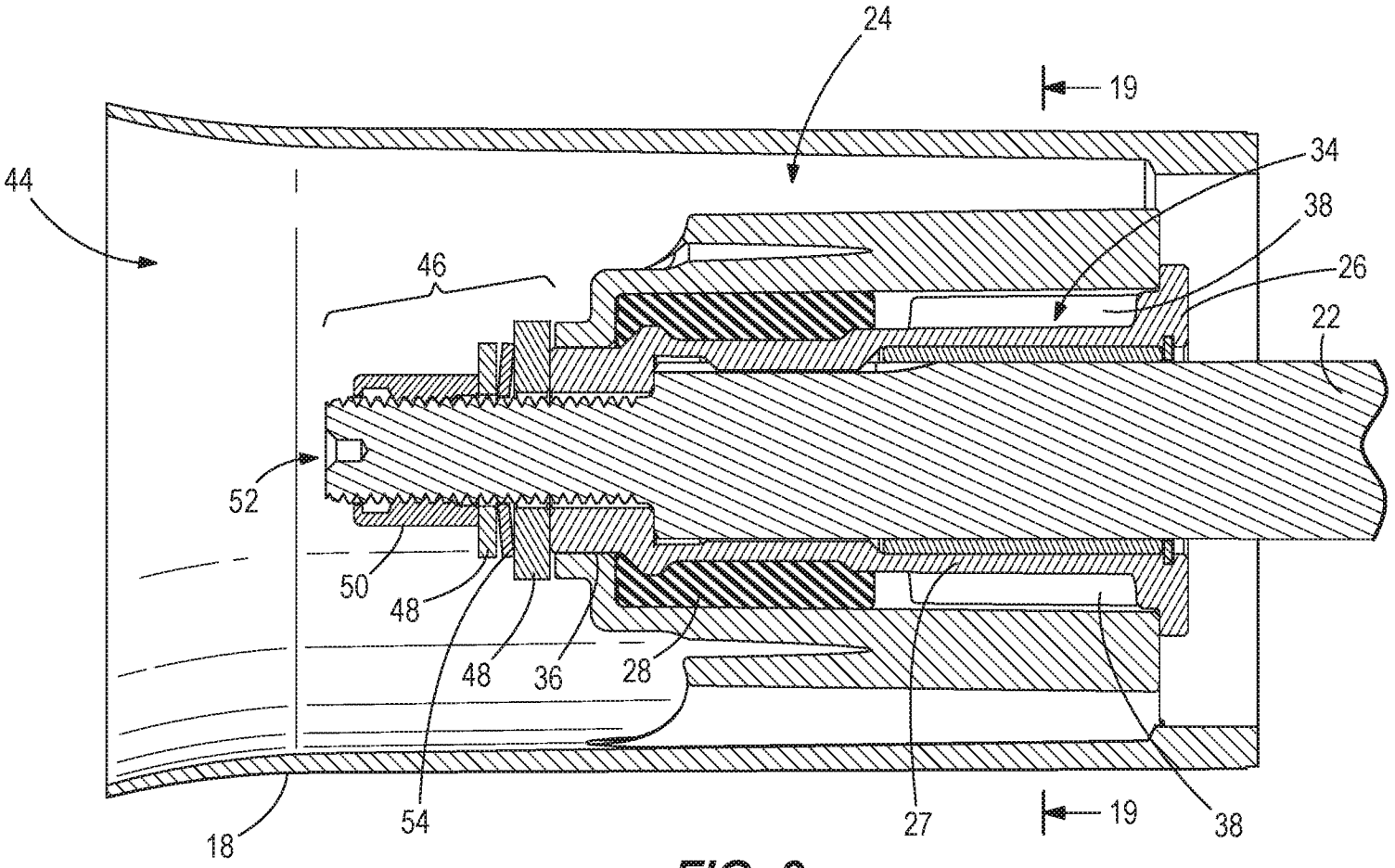
FIG. 3 is a view of section 3-3, taken in FIG. 2.
Figure 4:
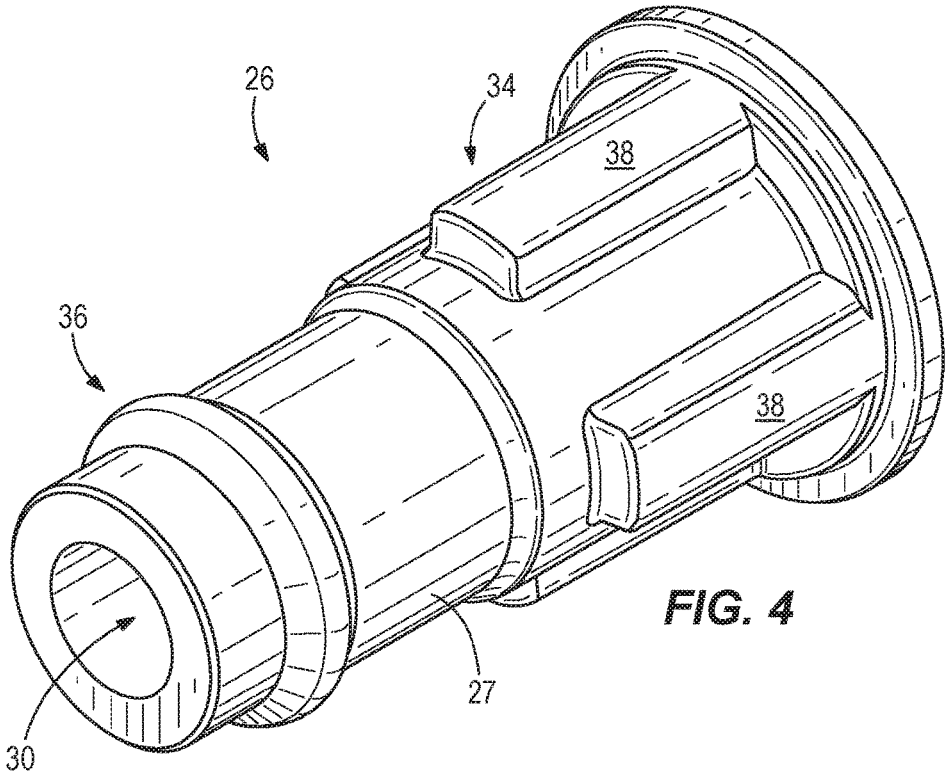
FIG. 4 is a perspective view of an adapter component for the shock absorbing hub assembly.
Figure 5:
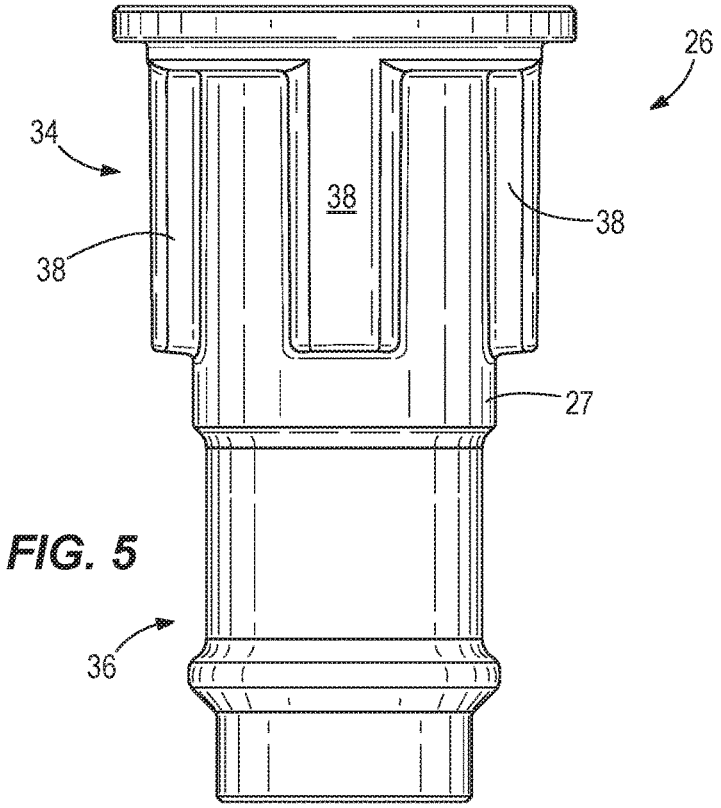
FIG. 5 is a front view of the adapter component.
Figure 6:
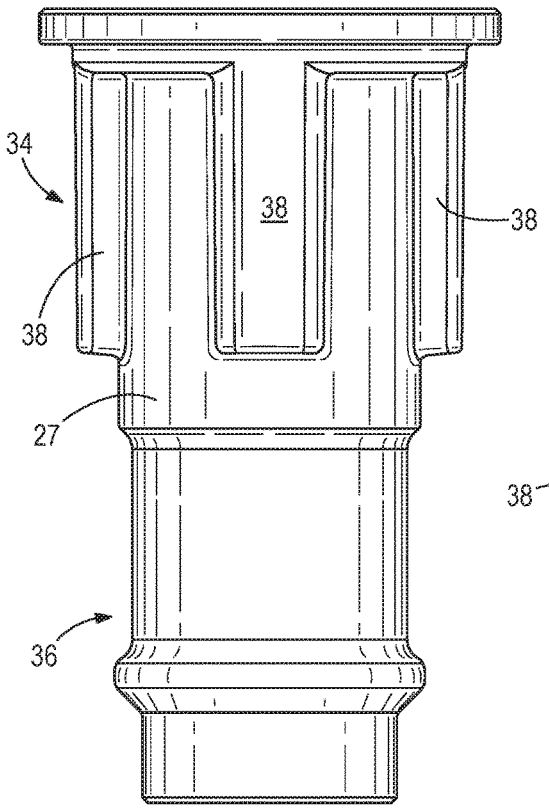
FIG. 6 is a rear view of the adapter component.
Figure 7:
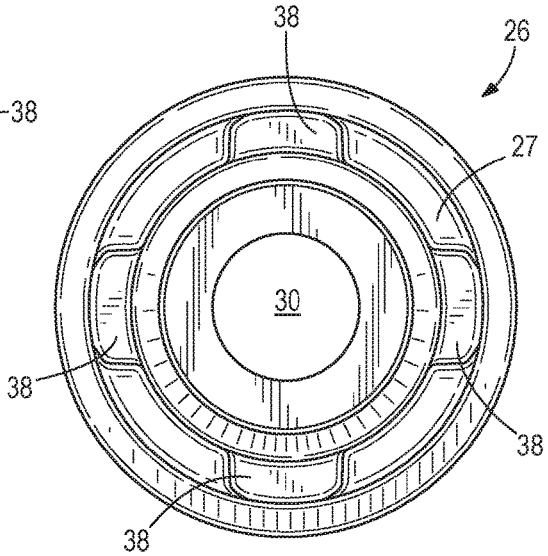
FIG. 7 is a first end view of the adapter component.
Figure 8:
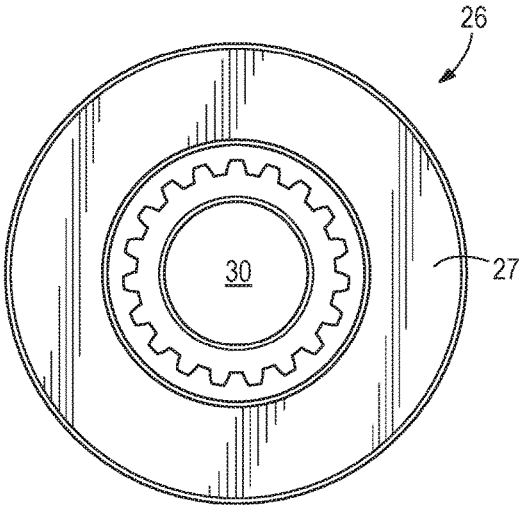
FIG. 8 is a second end view of the adapter component.
Figure 9:
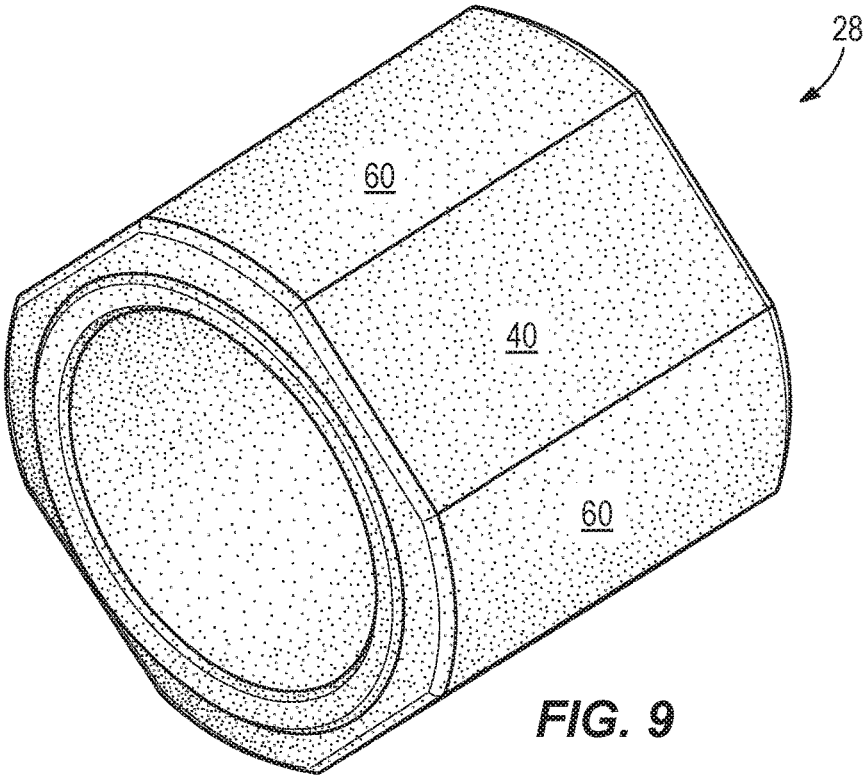
FIG. 9 is a perspective view of an elastic hub component for the shock absorbing hub assembly.
Figure 10:
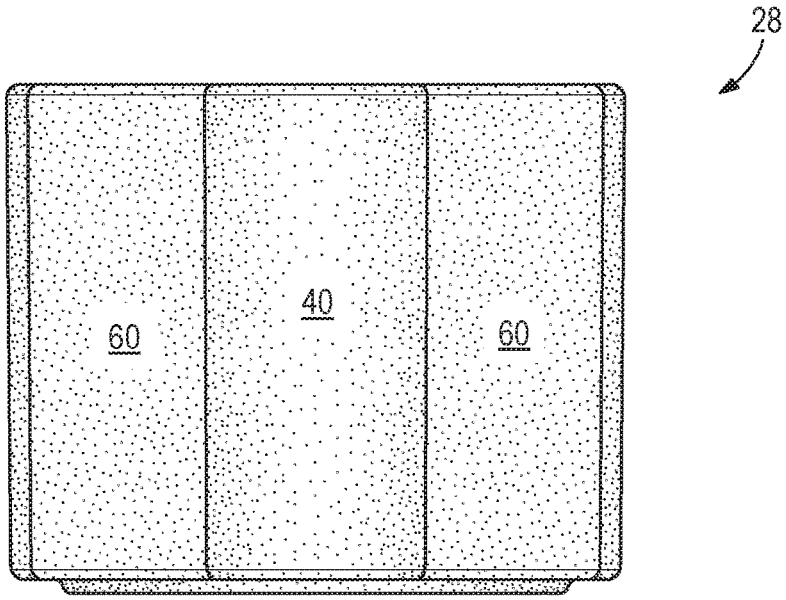
FIG. 10 is a front view of the elastic hub component.
Figure 11:
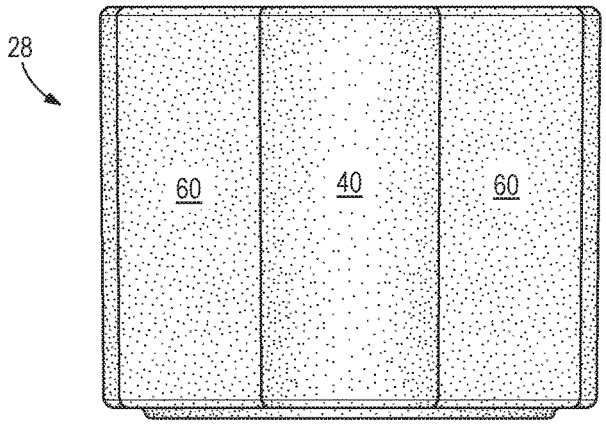
FIG. 11 is a rear view of the elastic hub component.
Figure 12:
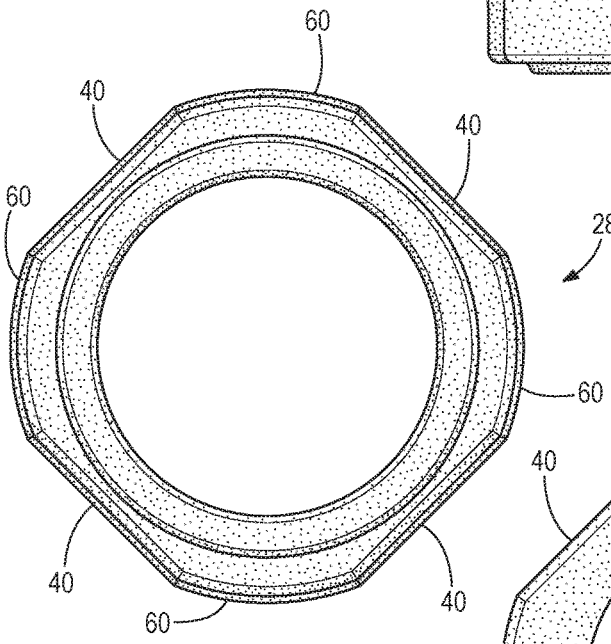
FIG. 12 is a first end view of the elastic hub component.
Figure 13:
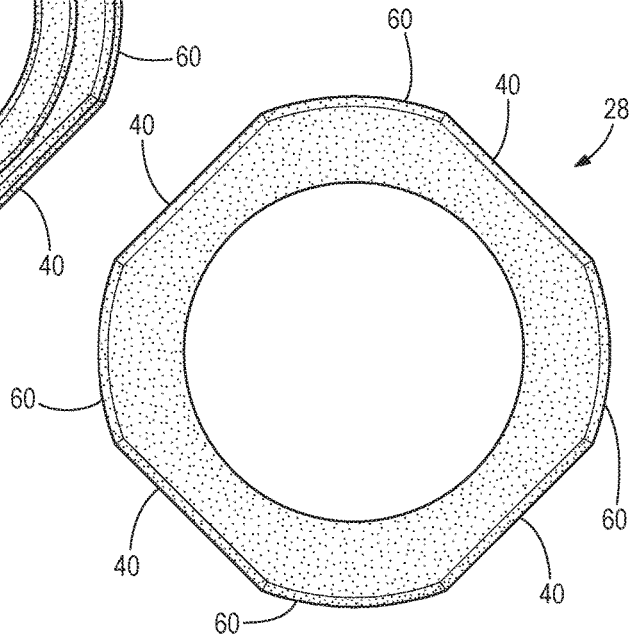
FIG. 13 is a second end view of the elastic hub component.
Figure 14:
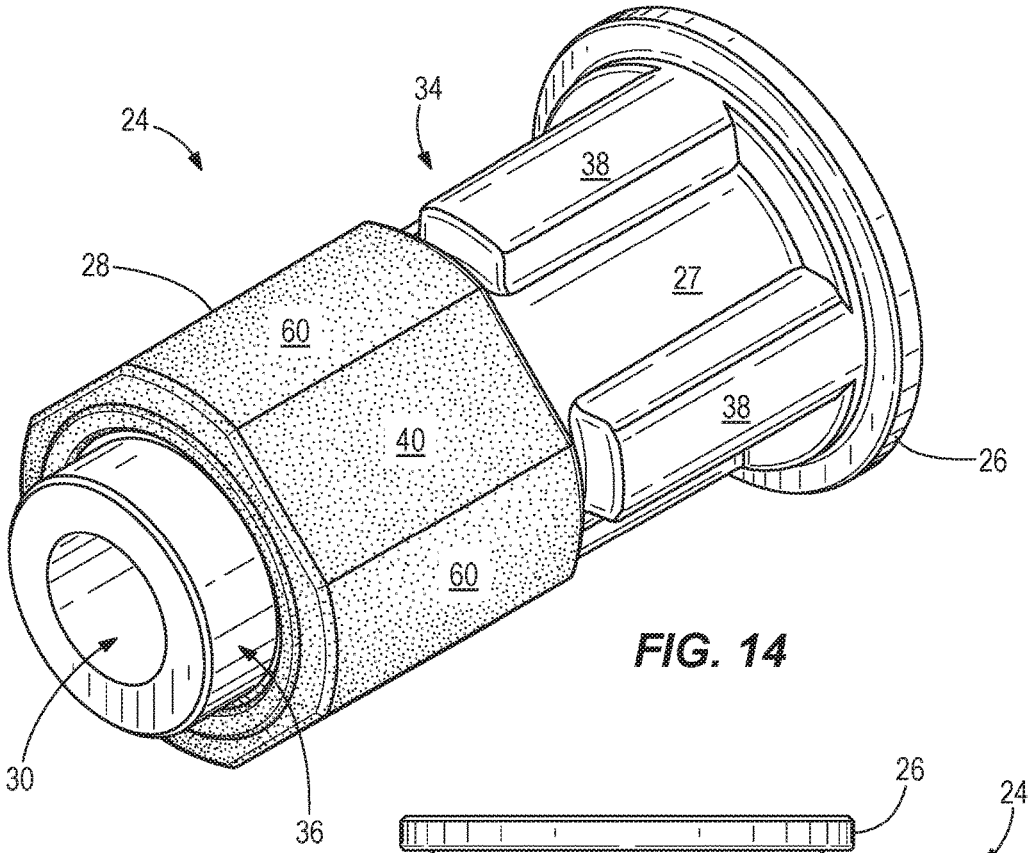
FIG. 14 is a perspective view of the adapter component and elastic hub component connected together.
Figure 15:
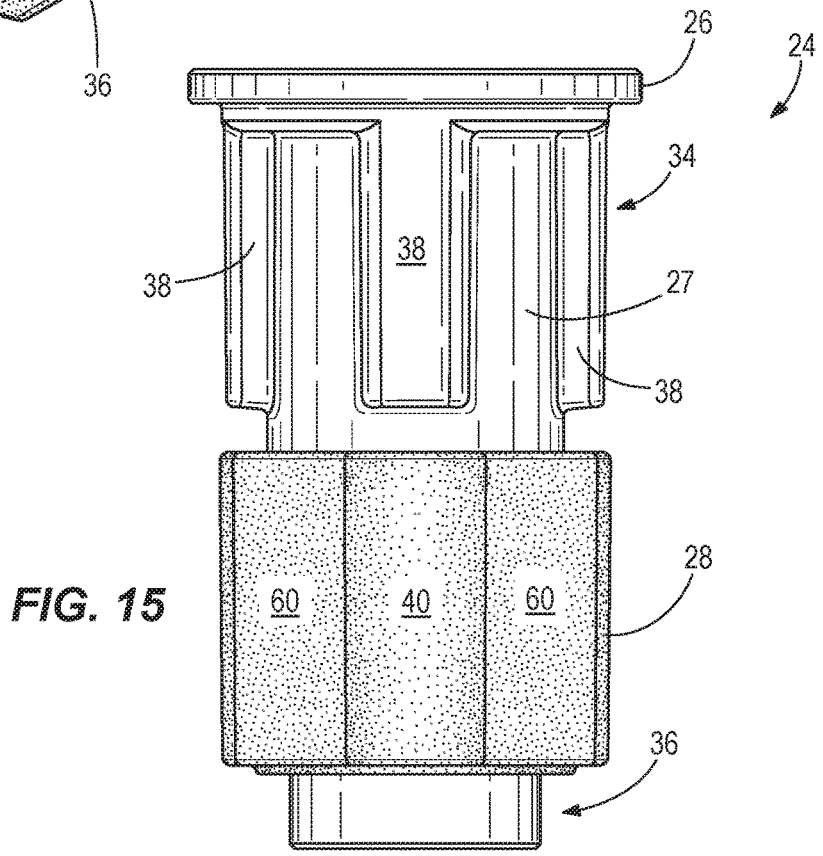
FIG. 15 is a front view of the assembled adapter component and elastic hub component.
Figure 16:
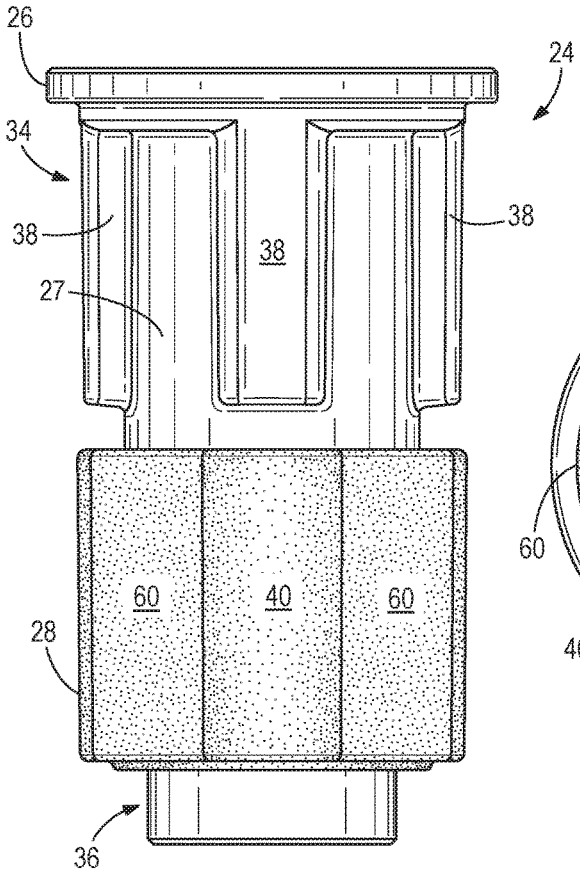
FIG. 16 is a rear view of the assembled adapter component and elastic hub component.
Figure 17:
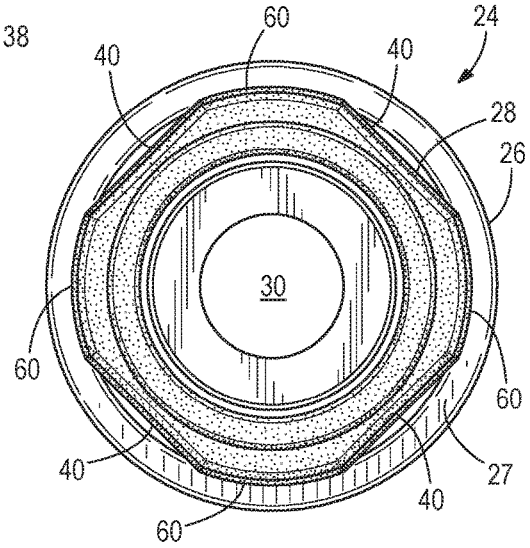
FIG. 17 is a first end view of the assembled adapter component and elastic hub component.
Figure 18:
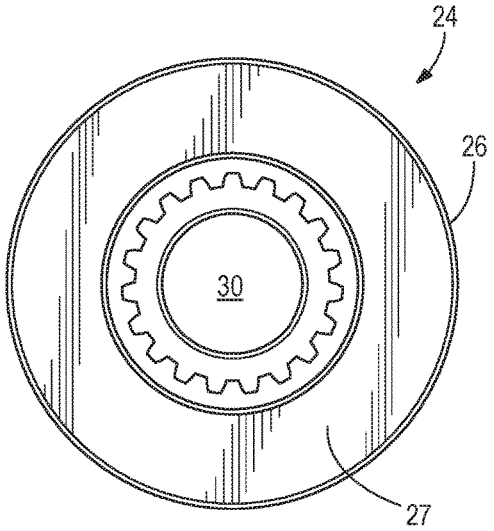
FIG. 18 is a second end view of the assembled adapter component and elastic hub component.

FIG. 1 depicts an outboard marine propulsion device 10 attached to the transom 12 of a marine vessel. The outboard marine propulsion device 10 has a conventional internal combustion engine 14 that drives a drive shaft 16 into rotation. The lower end of the drive shaft 16 is connected to a propeller hub 18 via a transmission and clutch assembly 20 and a propeller shaft 22 (FIG. 2). The configuration of the transmission and clutch assembly 20 is conventional and can for example include a dog clutch and associated bevel gears that engage the propeller shaft 22 in reverse, neutral and forward gears.

FIGS. 2-8 depict a first example of a shock absorbing hub assembly 24 that connects the propeller shaft 22 to the propeller hub 18 in a manner that reduces clutch rattle and isolates shift clunk of the transmission and clutch assembly 20. The shock absorbing hub assembly 24 includes an adapter component 26 and an elastic hub component 28. The adapter component 26 has an inner bore 30 that mates with a splined outer surface 32 of the propeller shaft 22. The adapter component 26 has a body 27 with opposite first and second end portions 34, 36. The first end portion 34 has a plurality of axially extending engagement surfaces 38, which in this example are ribs.

The elastic hub component 28 is disposed on the second end portion 36 of the body 27. The elastic hub component 28 has a plurality of planar outer engagement surfaces 40 that abut a plurality of corresponding inner engagement surfaces on an inner bore 44 of the propeller hub 18. The elastic hub component 28 has a square-shaped cross section. In this example, the planar outer engagement surfaces 40 include four planar outer engagement surfaces. Four rounded corner engagement surfaces 60 are interdigitated amongst the 4 planar outer engagement surfaces 40.

Figure 19:
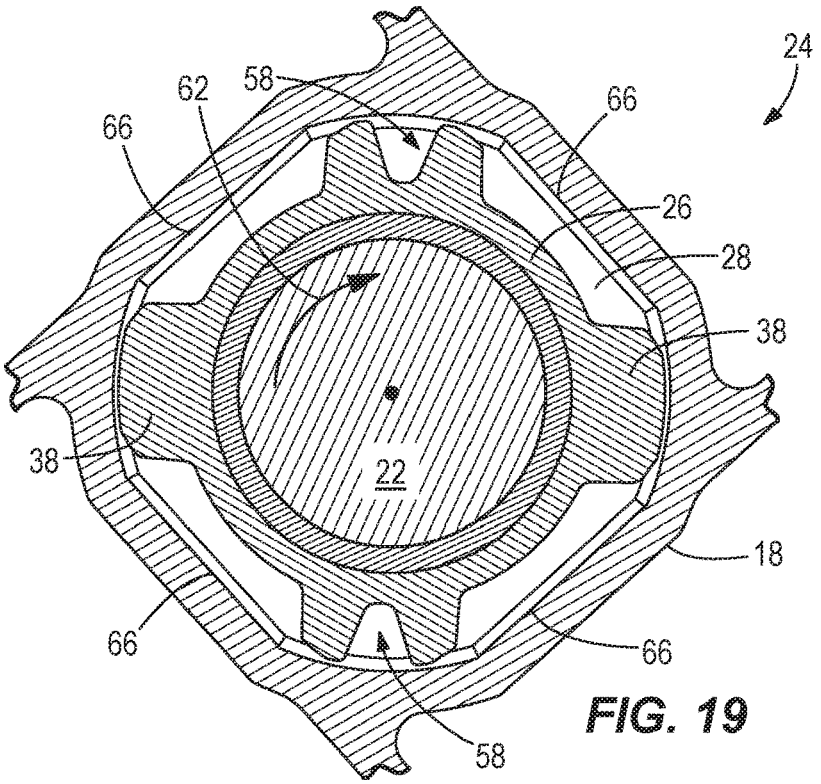
FIG. 19 is a view of section 19-19, taken in FIG. 3 showing start of initial rotation of the propeller shaft.
Figure 20:
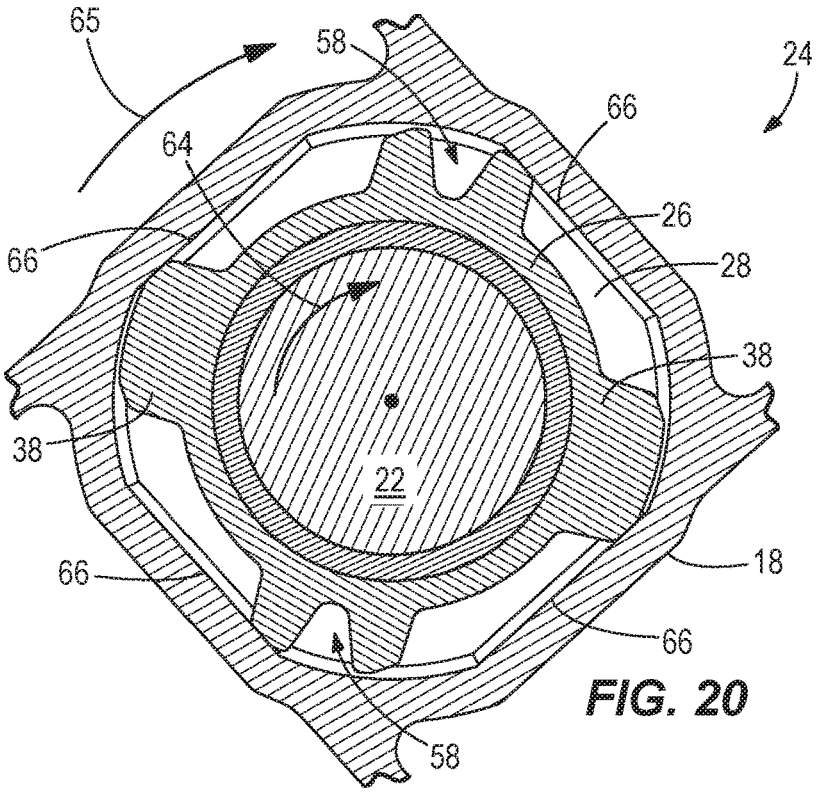
FIG. 20 is a view like shown in FIG. 19, showing further rotation of the propeller shaft.
Figure 21:
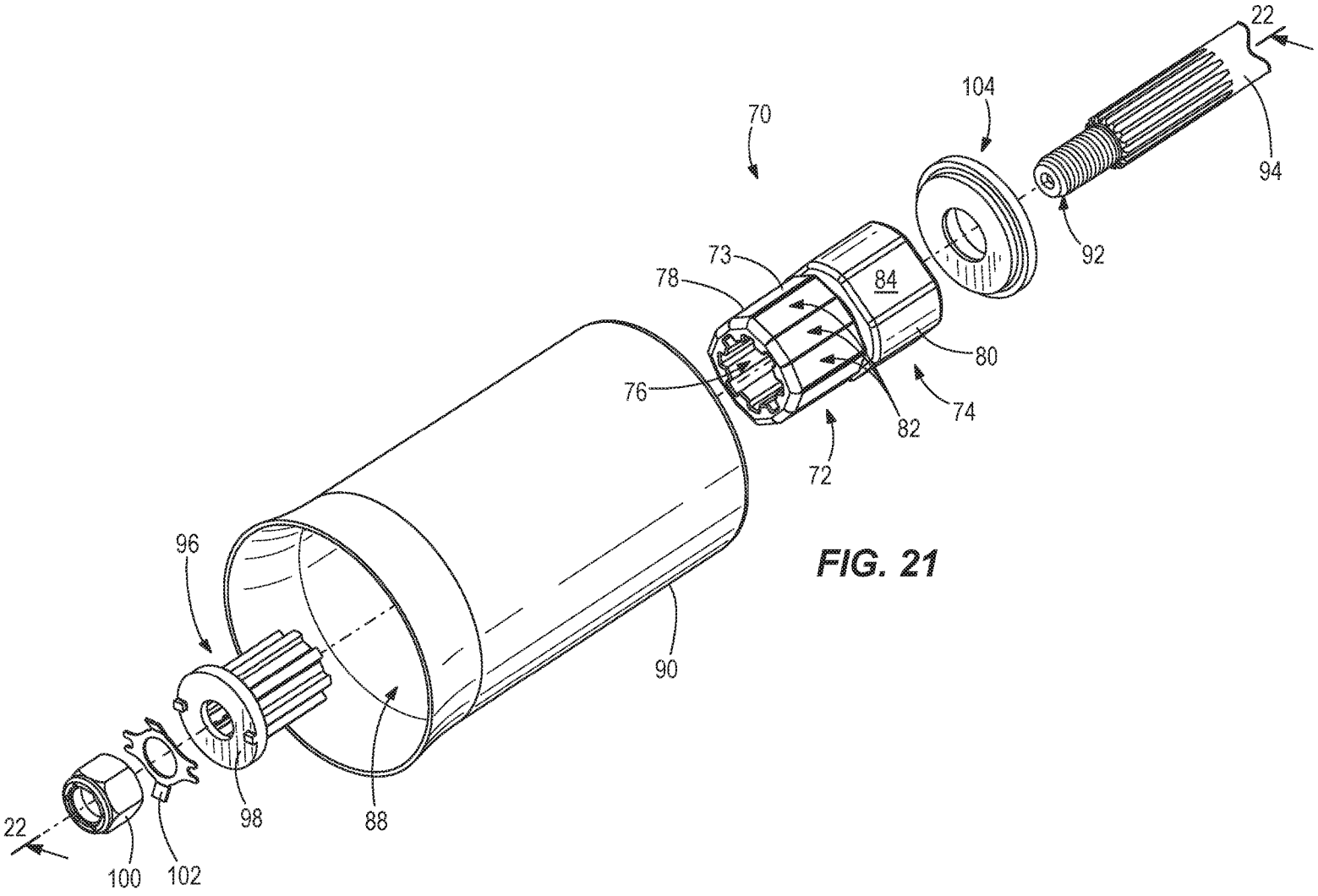
FIG. 21 is an exploded view of another example of a shock absorbing hub assembly for a marine propulsion device like the one shown in FIG. 1.
Figure 22:
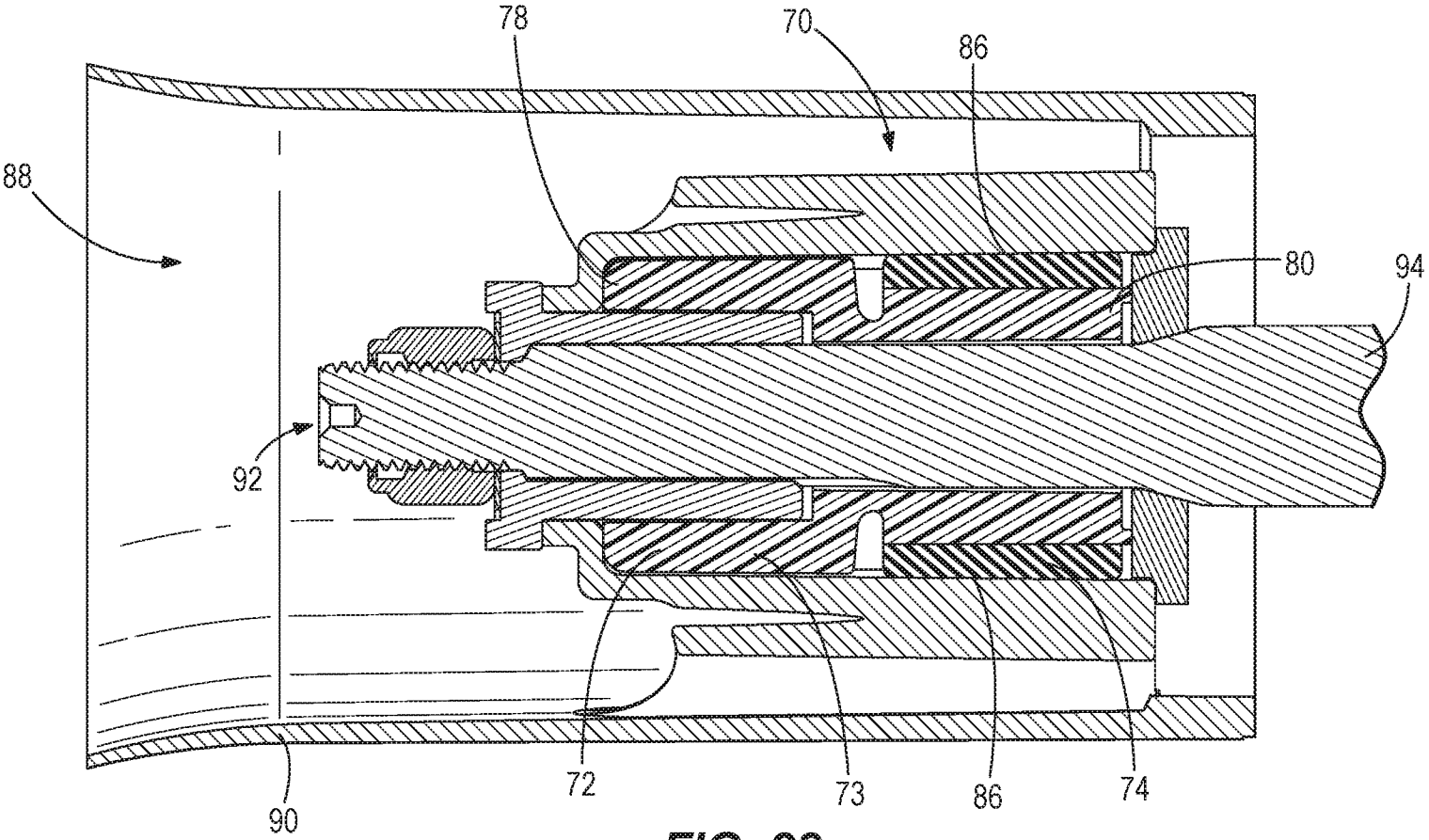
FIG. 22 is a view of section 22-22, taken in FIG. 21.
Figure 23:
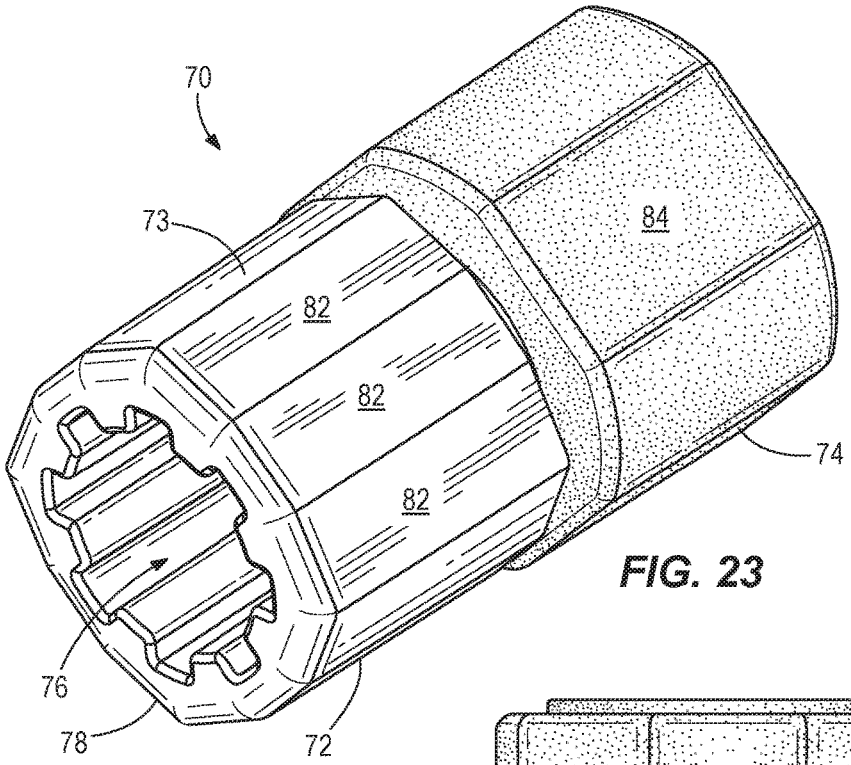
FIG. 23 is a perspective view of the assembled adapter component and elastic hub component shown in FIG. 21.
Figure 24:
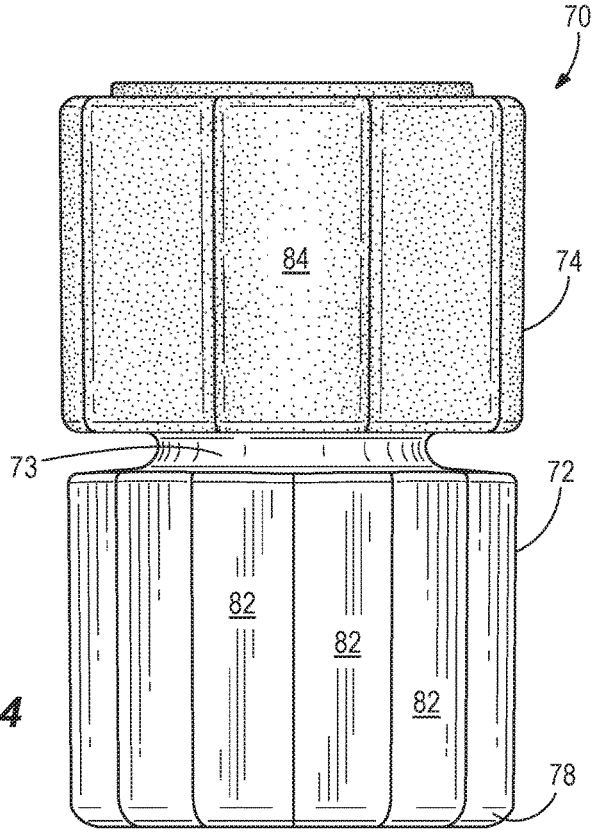
FIG. 24 is a front view of the assembled adapter component and elastic hub component shown in FIG. 21.
Figure 25:
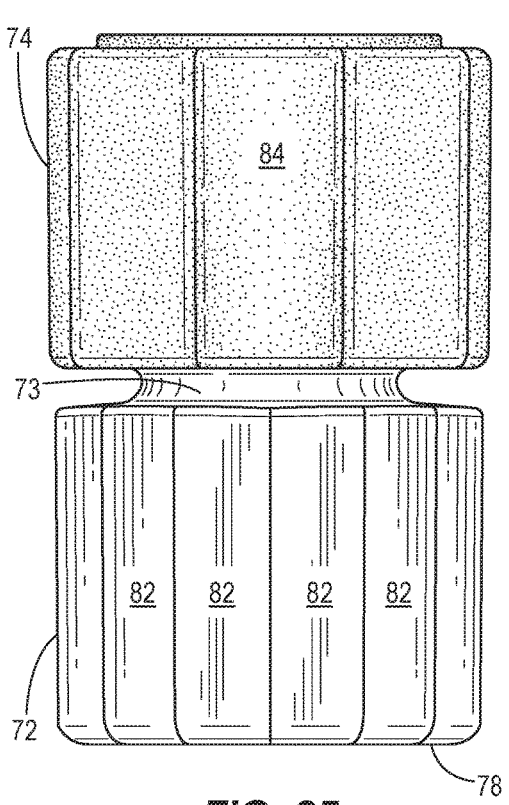
FIG. 25 is a rear view of the assembled adapter component and elastic hub component shown in FIG. 21.
Figure 26:
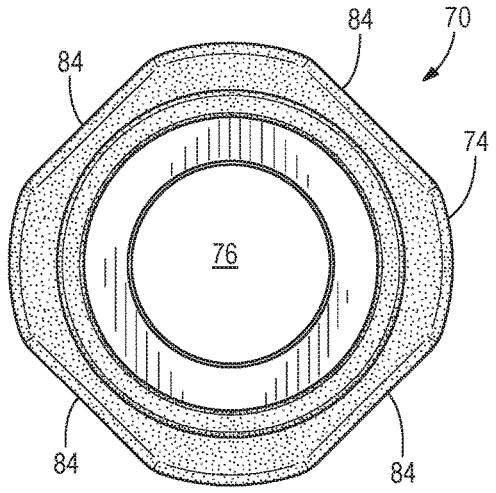
FIG. 26 is a first end view of the assembled adapter component and elastic hub component shown in FIG. 21.
Figure 27:
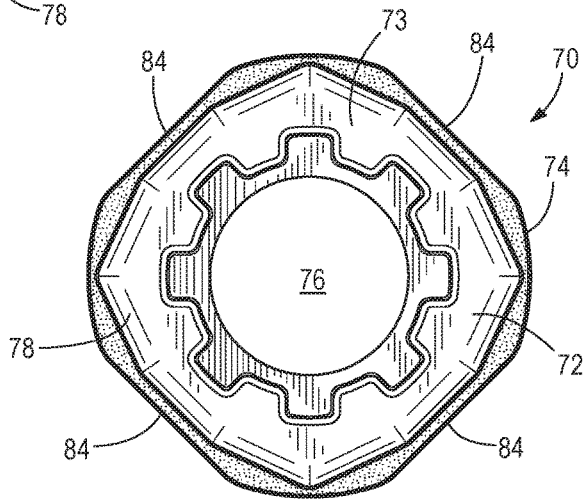
FIG. 27 is a second end view of the assembled adapter component and elastic hub component shown in FIG. 21.

The plurality of axially extending engagement surfaces 38 are spaced apart on an outer circumferential surface of the first end portion 34 of the body 27. The number of surfaces/ribs can vary from that shown. In this example, the plurality includes four ribs. FIGS. 2, 19 and 20 show examples wherein two of the four ribs include split ribs 58, which constitute a pair of smaller ribs. This is an optional feature to save on cost of materials and weight.

The second end portion 36 of the adapter component 26 is located closer to the free end 52 of the propeller shaft 22 than the first end portion 34 of the adapter component 26. In this example, the adapter component 26 is made of metal.

A connector assembly 46 connects the shock absorbing hub assembly 24 to the propeller shaft 22. The connector assembly 46 includes washers 48 and a nut 50 which are connected to a free end 52 of the propeller shaft 22. Optionally, disk spring 54 is sandwiched between the washers 48.

Referring now to FIGS. 19 and 20, upon initial rotation of the propeller shaft 22 (arrow 62), the elastic hub component 28 deflects and allows the adapter component 26 to rotationally travel with respect to the propeller hub 18 such that the initial rotation (arrow 62) does not cause corresponding rotation of the propeller hub 18 (see arrow 65). Upon further rotation of the propeller shaft 22 (see arrow 64), the plurality of axially extending engagement surfaces 38 on the adapter component 26 engage with the propeller hub 18 such that the further rotation 64 causes corresponding rotation of the propeller hub 18. Advantageously, the elastic hub component 28 has a spring rate that is uniquely selected to be small enough to reduce the noted rattle of the transmission and clutch assembly 20 and yet large enough to isolate shift clunk of the transmission and clutch assembly 20.

As shown in FIGS. 19 and 20, the propeller hub 18 has a plurality of stop surfaces 66 on its inner diameter that are engaged by the plurality of axially extending engagement surfaces 38 upon said further rotation 64 of the propeller shaft 22.

It will be recognized that opposite rotation (i.e. opposite arrow 62) of the propeller shaft 22 causes initial (opposite) deflection of the elastic hub component 28 prior to opposite rotation (i.e. opposite arrow 65) of the propeller hub 18.

Referring to FIGS. 21-27, a second embodiment is disclosed. In this embodiment, a shock absorbing hub assembly 70 includes an adapter component 72 and an elastic hub component 74. The adapter component 72 has a body 73 with opposite first and second end portions 78, 80. The first end portion 78 has a plurality of axially extending engagement surfaces 82. The elastic hub component 74 is disposed on the second end portion 80 of the adapter component 72 and has a plurality of planar outer engagement surfaces 84 that abut a plurality of corresponding inner engagement surfaces 86 on the inner bore 88 of the propeller hub 90. Unlike the embodiment shown in FIGS. 1-20, the adapter component 72 is made of plastic and the second end portion 80 of the adapter component 72 is located further from the free end 92 of the propeller shaft 94 than the first end portion 78 of the adapter component 72. A splined drive sleeve 96 is disposed on the propeller shaft 94 between the adapter component 72 and the propeller shaft 94. The splined drive sleeve 96 is made of metal and has an end stop surface 98 that is engaged by a nut 100 and locking washer 102 to secure the shock absorbing hub assembly 70 to the propeller shaft 94. The splines on the splined drive sleeve 96 engage with an internally splined surface of the inner bore 76 to rotationally secure the adapter component 72 to the splined drive sleeve 96 and the propeller shaft 94. An end washer 104 is located opposite the free end 92 of the propeller shaft 94 to axially secure the shock absorbing hub assembly 70 with respect to the propeller shaft 94.

Similar to the first embodiment, the shock absorbing hub assembly 70 is configured such that upon initial rotation of the propeller shaft 94 the elastic hub component 74 deflects and allows the adapter component 72 to rotationally travel with respect to the propeller hub 90 such that the initial rotation does not cause corresponding rotation of the propeller hub 90. Upon further rotation of the propeller shaft 94, the plurality of axially extending engagement surfaces 82 (which in this example are planar surfaces) on the adapter component 72 engage with the propeller hub 90 such that the further rotation causes corresponding rotation of the propeller hub 90. Advantageously, the elastic hub component 74 has a spring rate that is selected to be small enough to reduce the noted rattle of the transmission and clutch assembly 20 and yet large enough to isolate shift clunk in the transmission and clutch assembly 20.

In some examples, the present disclosure thus provides a shock absorbing hub assembly 24 having an inner adapter component 26 (e.g. a cast metal part) over-molded with rubber and an elastic hub component 28 (e.g. rubber part). The adapter component is inserted into the elastic hub component to create an assembly that is then inserted into a substantially square bore of a propeller hub 18. The entire assembly (metal adapter component, rubber elastic hub component, and propeller) is then coupled to a propeller shaft 22 and secured in place, for example by washers, a disk spring, and a nut.

The outer surface of the elastic hub component can have a substantially square shape or section and the elastic hub component works with the metal adapter component to tolerate, or accommodate, at least approximately 12 degrees of rotation (for a 1.25 inch diameter propeller shaft), though even more is possible. This resiliency allows the assembly to absorb shift shock prior to the surfaces of the adapter component making contact with the propeller hub and providing high torque capability and durability. The square rubber elastic hub component fits into a square inner propeller hub bore, while the square shape prevents relative motion of the outer section of the rubber. The rubber shears to allow for relative rotational deflection between the propeller shaft and the propeller hub, thus providing an initial "soft" rate of deflection. After the prescribed allowable "soft" displacement, the metal surfaces/ribs on the adapter component make contact with the corners of the square shape of the inner propeller hub bore to resist higher torque loads. In some examples, there are four substantially rectangular metal ribs that protrude from the cylindrically shaped inner adapter component, though one or more of those may be split, or divided (a middle section removed) to save material. This provides a resilient, shock absorbing system that is intended to provide at least 12 degrees of rubber dampened cushion at low hub torques prior to reaching a nearly ridged/solid hub engagement.

Advantageously, the square, non cylindrical, outer shape of the assembly does not require a strong compression fit like prior art cylindrical, press-in rubber hubs. A one-inch diameter propeller shaft could utilize an even taller rubber section (the propeller bore is the same size but the propeller shaft diameter is smaller, leaving a larger void to fill) allowing it to tolerate even more that 12 degrees of rotation to further absorb shock and mitigate clutch rattle. The dynamic to static change rate of rubber provides additional dampening for high speed impacts, further cushioning shift impact loads, while the stainless steel (metal) section provides a durable hub at higher torque loads.

As disclosed herein above with respect to FIGS. 21-27, the shock absorbing hub assembly 70 can be configured for use with one-inch diameter propeller shafts, with a splined drive sleeve 96 that substantially replaces the inner metal component and a hub component 72 (plastic component) that is added to the system. The splined drive sleeve 96 can be inserted into the plastic hub component and then inserted, along with the rubber hub component 74, into the propeller hub. A thrust washer is then placed on the propeller shaft, followed by the shock absorbing hub assembly (rubber hub component, plastic hub component, splined drive sleeve and propeller) all secured by a washer and a nut fashioned to the propeller shaft.

The examples described herein above can be used with existing propellers having 1.25 inch, 1.0 inch, or smaller diameter propeller shafts with forward tapers or other solid, square bore hub systems. In addition to providing the shock absorbing benefits detailed above, the embodiments described herein above can also mitigate clutch rattle. The embodiments can be used with new propulsion systems and also, advantageously, with existing propeller hub bores of older propulsion systems. The two stage load design eliminates clutch rattle and minimizes shift clunk in a durable package that can be used with many propulsion systems. The application flexibility of the described embodiments makes ordering, purchasing, and installing the hub system easier and less confusing for consumers.

Optionally, the shock absorbing hub assembly can have a frangible portion disposed between the first and second end portions of the adapter component. In certain examples, the frangible portion can be an area of reduced wall thickness, such as a portion having a radial thickness that is less than a radial thickness of the first end portion of the adapter component and less than a radial thickness of the second end portion of the adapter component. The location of the frangible portion can vary, and in some examples could be located at the location of the reference number lead line for body 73 in FIGS. 24 and 25.

In the present disclosure, certain terms have been used for brevity, clearness and understanding. No unnecessary limitations are to be implied therefrom beyond the requirement of the prior art because such terms are used for descriptive purposes only and are intended to be broadly construed. The different devices and methods described herein may be used alone or in combination with other devices and methods. Various equivalents, alternatives and modifications are possible within the scope of the appended claims.

What is claimed is:

1. A shock absorbing hub assembly for a marine propulsion device having a propeller shaft and a propeller hub, the shock absorbing hub assembly comprising:

an adapter component having an inner bore that mates with a splined outer surface of the propeller shaft, the adapter component having a body comprising opposite first and second end portions, wherein the first end portion has an outer diameter with a plurality of axially extending engagement surfaces for engaging stop surfaces on an inner diameter of the propeller hub, and wherein the second end portion has an outer diameter with a continuously smooth surface such that the second end portion has a circular cross-section; and an elastic hub component over-molded onto only the continuously smooth surface of the outer diameter of the second end portion of the body, the elastic hub component having a plurality of planar outer engagement surfaces that abut a plurality of corresponding inner engagement surfaces on an inner bore of the propeller hub;

wherein upon initial rotation of the propeller shaft, the elastic hub component deflects so as to allow the adapter component to rotationally travel with respect to the propeller hub such that said initial rotation of the propeller shaft does not cause corresponding rotation of the propeller hub;

wherein upon further rotation of the propeller shaft, the plurality of axially extending engagement surfaces on the adapter component engages with the stop surfaces on the inner diameter of the propeller hub such that said further rotation of the propeller shaft causes corresponding rotation of the propeller hub; and wherein the elastic hub component has a spring rate that is small enough to reduce rattle of a clutch associated with the marine propulsion device and yet large enough to isolate shift clunk of a transmission associated with the marine propulsion device.

2. The shock absorbing hub assembly according to claim 1, further comprising a connector assembly that connects the shock absorbing hub assembly to the propeller shaft.

3. The shock absorbing hub assembly according to claim 2, wherein the connector assembly comprises a washer and a nut connected to a free end of the propeller shaft.

4. The shock absorbing hub assembly according to claim 3, wherein the connector assembly comprises a disk spring sandwiched between two washers.

5. The shock absorbing hub assembly according to claim 1, comprising a frangible portion between the first and second end portions of the adapter component.

6. The shock absorbing hub assembly according to claim 5, wherein the frangible portion has a radial thickness that is less than a radial thickness of the first end portion of the adapter component and less than a radial thickness of the second end portion of the adapter component.

7. The shock absorbing hub assembly according to claim 1, wherein the plurality of axially extending engagement surfaces is spaced apart on an outer circumferential surface of the first end portion of the adapter component.

8. The shock absorbing hub assembly according to claim 7, wherein the plurality of axially extending engagement surfaces includes four ribs.

9. The shock absorbing hub assembly according to claim 8, wherein two of the four ribs each comprise split rib portions that together comprise a pair of smaller ribs.

10. The shock absorbing hub assembly according to claim 1, wherein the elastic hub component has a square-shaped cross section and wherein the plurality of planar outer engagement surfaces includes four planar outer engagement surfaces.

11. The shock absorbing hub assembly according to claim 10, further comprising four corner engagement surfaces interdigitated amongst the four planar outer engagement surfaces.

12. The shock absorbing hub assembly according to claim 1, wherein the adapter component is made of metal.

13. The shock absorbing hub assembly according to claim 12, wherein the second end portion of the adapter component is located closer to a free end of the propeller shaft than the first end portion of the adapter component.

14. The shock absorbing hub assembly according to claim 1, wherein the adapter component is made of plastic.

15. The shock absorbing hub assembly according to claim 14, wherein the second end portion of the adapter component is located further from a free end of the propeller shaft than the first end portion of the adapter component.

16. The shock absorbing hub assembly according to claim 15, further comprising a splined drive sleeve disposed on the propeller shaft between the body and the propeller shaft, the splined drive sleeve comprising a splined outer surface for engaging with the body.

17. The shock absorbing hub assembly according to claim 16, wherein the splined drive sleeve is made of metal.

18. A marine propulsion device comprising:

an engine that drives a propeller shaft and propeller hub into rotation via a clutch and a transmission, the propeller hub having an inner diameter defined by a plurality of planar stop surfaces and an axially adjacent contiguous and coplanar plurality of engagement surfaces;

a shock absorbing hub assembly that connects the propeller shaft to the propeller hub, the shock absorbing hub assembly comprising:

an adapter component having an inner bore that mates with a splined outer surface of the propeller shaft, the adapter component comprising a body having opposite first and second end portions, wherein the first end portion has a plurality of axially extending engagement surfaces for engaging the plurality of planar stop surfaces on an inner diameter of the propeller hub;

an elastic hub component over-molded onto only the second end portion of the body, the elastic hub component having a plurality of planar outer engagement surfaces that abut the plurality of engagement surfaces of the propeller hub;

wherein upon initial rotation of the propeller shaft, the elastic hub component deflects so as to allow the adapter component to rotationally travel with respect to the stop surfaces on the inner diameter of the propeller hub such that said initial rotation of the propeller shaft does not cause corresponding rotation of the propeller hub;

wherein upon further rotation of the propeller shaft, the plurality of axially extending engagement surfaces on the adapter component engages with the propeller hub such that said further rotation of the propeller shaft causes corresponding rotation of the propeller hub; and wherein the elastic hub component has a spring rate that is small enough to reduce rattle of the clutch and yet large enough to isolate shift clunk of the transmission.

19. The marine propulsion device according to claim 18, wherein the second end portion has an outer diameter with a continuously smooth surface such that the second end portion has a circular cross-section.

20. A method of making a shock absorbing hub assembly for a marine propulsion device having a propeller shaft and a propeller, the method comprising:

providing an adapter component having an inner bore that mates with a splined outer surface of the propeller shaft, the adapter component comprising a body having opposite first and second end portions, wherein the first end portion has an outer diameter with a plurality of axially extending engagement surfaces for engaging stop surfaces on an inner diameter of the propeller hub, and wherein the second end portion has an outer diameter with a continuously smooth surface such that the second end portion has a circular cross-section;

over-molding an elastic hub component on only the continuously smooth surface of the outer diameter of the second end portion of the body, the elastic hub component having a plurality of planar outer engagement surfaces that abut a plurality of corresponding inner engagement surfaces on an inner bore of the propeller hub;

wherein upon initial rotation of the propeller shaft, the elastic hub component deflects and allows the adapter component to rotationally travel with respect to the stop surfaces on the inner diameter of the propeller hub such that said initial rotation of the propeller shaft does not cause corresponding rotation of the propeller hub;

wherein upon further rotation of the propeller shaft, the plurality of axially extending engagement surfaces on the adapter component engages with the propeller hub such that said further rotation of the propeller shaft causes corresponding rotation of the propeller hub; and selecting a material of the elastic hub component so that the elastic hub component has a spring rate that is small enough to reduce rattle of a clutch and yet large enough to isolate shift clunk of a transmission.

* * * * *